US009206571B2

(12) United States Patent
Marantier

(10) Patent No.: US 9,206,571 B2
(45) Date of Patent: Dec. 8, 2015

(54) MOVABLE FLOATING MOORAGE

(76) Inventor: Frédéric Marantier, Monaco (MC)

( * ) Notice: Subject to any disclaimer, the term of this patent is extended or adjusted under 35 U.S.C. 154(b) by 0 days.

(21) Appl. No.: 14/352,835

(22) PCT Filed: Oct. 19, 2011

(86) PCT No.: PCT/IB2011/002674

§ 371 (c)(1),
(2), (4) Date: Apr. 18, 2014

(87) PCT Pub. No.: WO2013/057531

PCT Pub. Date: Apr. 25, 2013

(65) Prior Publication Data

US 2014/0245940 A1 Sep. 4, 2014

(51) Int. Cl.

| | |
|---|---|
| ***B63B 35/34*** | (2006.01) |
| ***E02B 3/06*** | (2006.01) |
| ***B63B 21/00*** | (2006.01) |
| ***B63B 35/38*** | (2006.01) |

(52) U.S. Cl.

CPC ..... *E02B 3/064* (2013.01); *B63B 21/00* (2013.01); *B63B 35/34* (2013.01); *B63B 35/38* (2013.01)

(58) Field of Classification Search

CPC ..... B63B 35/34; E02B 3/06; E02B 3/064

USPC ..... 114/263; 405/218, 219

See application file for complete search history.

(56) References Cited

U.S. PATENT DOCUMENTS

| | | | | |
|---|---|---|---|---|
| 3,672,178 | A | 6/1972 | Trautwein | |
| 7,600,946 | B2 * | 10/2009 | Bernadac | 405/219 |

FOREIGN PATENT DOCUMENTS

| | | |
|---|---|---|
| FR | 2863581 A1 | 6/2005 |
| GB | 2236716 A | 4/1991 |

* cited by examiner

*Primary Examiner* — Lars A Olson

(74) *Attorney, Agent, or Firm* — Miller, Matthias & Hull LLP

(57) ABSTRACT

A movable floating moorage including a set of n parallel floating booms, each comprising a main pontoon and secondary pontoons extending in a transverse direction. Some of the secondary pontoons are in register with one another in two adjacent booms and are adapted to bear on one another in the transverse direction. The moorage includes two series of n+1 lines actuated by winches and including, for each boom, two lines extending from this boom in two opposite ways in the transverse direction and connected respectively, either to an adjacent floating boom, or to a fixed anchorage. The booms are connected together and to any fixed support solely by these two series of lines.

15 Claims, 12 Drawing Sheets

MOVABLE FLOATING MOORAGE

CROSS-REFERENCE TO RELATED APPLICATIONS

This application is a 35 USC §371 U.S. national stage filing of International Patent Application No. PCT/IB2011/002674 filed on Oct. 19, 2011.

FIELD OF THE DISCLOSURE

The invention relates to movable floating moorages for harbors.

BACKGROUND OF THE DISCLOSURE

Harbors and marinas where boats and yachting ships berth are often equipped with floating moorage, composed of main floating pontoons and secondary floating pontoons (also called finger pontoons or finger piers) which are usually disposed at right angles from the main floating pontoons. The secondary pontoons are used for mooring and separating the ships, and for gaining access to these ships. Each main pontoon and the corresponding secondary pontoons constitute a floating boom.

The floating booms of a harbor are usually fixed or secured permanently, and are separated from one another by access channels which enable ships to maneuver for entering or leaving the floating booms. These access channels have commonly a width which is 1.5 to 2 times the average length of the ships which are received in the floating booms.

However, the presence of these multiple access channels results a significant loss of mooring surface in the harbor, and therefore a large loss in the number of ships which can be berthed in the harbor.

To mitigate this drawback, it has already been proposed to provide maneuvering devices for moving the floating booms relative to one another, in order to:

- bring the booms together for obtaining a compact configuration of the floating booms when no ship is to enter or leave the floating booms;
- and separate some of the booms for creating the access channels on demand.

GB-A-2 236 716 discloses such a movable floating moorage including at least a set of n parallel floating booms, n being an integer larger than 1 and each floating boom comprising a main floating pontoon extending along a first horizontal direction which is common to all main pontoons of the set of floating booms;

said movable floating moorage further including an actuating system including at least one flexible line which extends in a second direction substantially perpendicular to said first direction and adapted to selectively move each floating boom in both ways in said second direction.

In this document, flexible lines are connected to the floating booms at one end thereof in the first direction, while the opposite end of each boom is connected to a sliding shoe which is driven and guided along an elongate member such as a rail sliding on a fixed pontoon.

One problem associated with this conception is that the driven pontoons are moveably connected to a rigid elongate member which controls the sliding movement of the driven pontoons which is not compatible with the flexibility necessary for a boom to adapt to the natural movements of the surface of the water.

Another problem associated with this conception is that the floating booms may become blocked due to the jamming of their sliding connection with the above mentioned rigid elongate member. Further, this conception is not readily adaptable on existing floating moorages and requires heavy investment.

SUMMARY OF THE DISCLOSURE

One objective of the present invention is to mitigate these drawbacks.

To this end, according to the invention, a floating moorage according to the invention is characterized in that the floating booms are connected together and to any fixed support in a way enabling free movements in all directions perpendicular to the second direction, and in that said floating booms comprise spacing members which are adapted to form an abutment in the second direction for said floating booms, for maintaining the respective main pontoons of said floating booms at a predetermined minimum distance from one another and from adjacent fixed structures.

Thanks to these dispositions, jamming of the floating booms is avoided due to the suppleness of the at least one line of the assembly of floating booms while stability is guaranteed by the self alignment due to the tensioning of the lines and the abutment in register of the terminal extremities of spacing members of the floating booms in the second direction when the floating booms are brought together. Further, using the invention on existing floating moorages is relatively easy and does not require heavy investment but rather modifications and the addition of actuating system(s).

It should be noted that said at least one line may be constituted either by a series of separate cables or chains or ropes, or by a continuously cable, chain or rope, as it will clearly appear from the following description.

In various embodiments of the floating moorage according to the invention, one may possibly use in addition one and/or other of the following features (which can be used either alone or in combination):

said actuating system includes:

- a series of n+1 first lines extending between two first fixed anchorages, substantially in a second horizontal direction which is substantially perpendicular to said first direction, said series of first lines including, for each floating boom, two first lines extending from said floating boom in two opposite ways in the second direction and connected respectively, either to an adjacent floating boom, or to one of said first fixed anchorages;
- winches which are respectively adapted to wind and unwind each of the n+1 first lines to move independently the n parallel floating booms relative to one another in the second direction;

said actuating system further includes a series of n+1 second lines extending substantially in the second direction between two second fixed anchorages and including, for each floating boom, two second lines extending from said floating boom in two opposite ways in the second direction and connected respectively, either to an adjacent floating boom, or to one of said two a second fixed anchorages, said second lines being respectively spaced apart from the corresponding first lines, and said winches are also respectively adapted to wind and unwind each of the n+1 second lines to move independently the n parallel floating booms relative to one another in the second direction;

the series of first lines forms a continuous cable, chain or rope which extends continuously between the two first fixed anchorages and which is wound on each of the n first winches, and the series of second lines forms a second continuous cable, chain or rope which extends continuously between the two second fixed anchorages and which is wound on each of the n second winches;

said winches comprise:

n+1 first winches which are respectively connected to the n+1 first lines and adapted to wind and unwind independently each of the n+1 first lines;

and n+1 second winches which are respectively connected to the n+1 second lines and adapted to wind and unwind independently each of the n+1 second lines;

said winches comprise:

n first winches which are respectively mounted on the n floating booms, the first winch of each floating boom being connected to the two first lines extending from said floating boom and said two first lines being wound on said first winch in the same angular direction, so that winding one of said first lines on said first winch involves simultaneous unwinding of the other of said two first lines;

and n second winches which are respectively mounted on the n floating booms, the second winch of each floating boom being connected to the two second lines extending from said floating boom and said two second lines being wound on said second winch in the same angular direction, so that winding one of said second lines on said second winch involves simultaneous unwinding of the other of said two second lines;

said winches comprise n+1 winches which are respectively connected to both the n+1 first lines and the n+1 second lines, each winch being connected to corresponding first and second lines which extend from the same side of one of the floating booms, so as to wind and unwind independently both of said corresponding first and second lines;

said winches are motorized;

at least some of said winches are driven by pair by a common motor which is independently coupled by clutches to each winch of said pair;

each winch is adapted to exert a controlled traction force on a corresponding line which is wound on said winch;

each floating boom comprises at least two spacing members extending on both sides of the main pontoon thereof;

wherein each floating boom comprises secondary floating pontoons extending from the main pontoon substantially in the second direction, said secondary pontoons including spacing secondary pontoons which constitute at least some of said spacing members;

said spacing secondary pontoons are disposed in mutual correspondence in each pair of adjacent floating booms of the set of parallel floating booms, and the spacing secondary pontoons which are disposed in mutual correspondence between the main pontoons of said pair of adjacent floating booms, are adapted to bear on one another in the second direction for maintaining the respective main pontoons of said adjacent floating booms at said predetermined minimum distance from one another when the actuating system brings together said adjacent floating booms;

the actuating system includes a control system which automatically controls said at least one line and which includes:

remote control devices which are distributed to users of the floating moorage and which include a user identification code identifying said users;

a communication interface adapted to communicate remotely with said control devices;

and at least a processing unit which is adapted to:

upon reception of a user identification code from a remote control device, determining a mooring place in one of the floating booms, corresponding to the user identification code, determining movements of floating booms necessary to open an access channel enabling a ship to access said mooring place or leave said mooring place, control said at least one line to perform said movements;

at least one of the floating booms is fitted with a sewage installation which is connected to a fixed sewer by a flexible conduit which is adapted to deform when the floating boom is moved by the actuating system.

BRIEF DESCRIPTION OF THE DRAWINGS

Other features and advantages of the invention appear from the following detailed description of several embodiments thereof, given by way of non-limiting example, and with reference to the accompanying drawings.

In the drawings.

DETAILED DESCRIPTION OF THE DISCLOSURE

In the various figures, the same references designate identical or similar elements.

Figure 1:
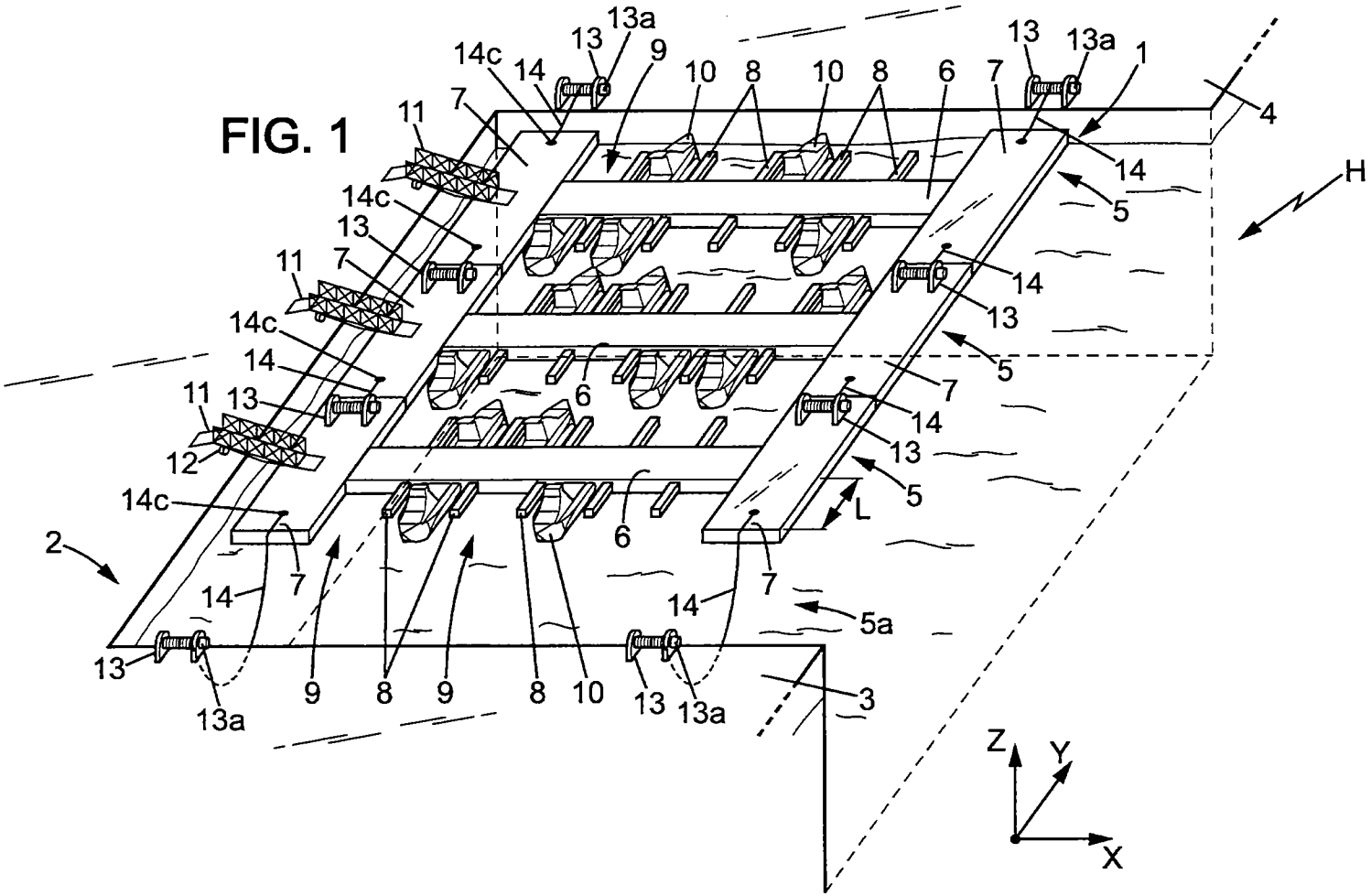
FIG. 1 is a diagrammatic view of a harbor including a floating moorage according to a first embodiment of the invention.

FIG. 1 shows a harbor H in which is installed a floating moorage 1 according to a first embodiment of the invention.

The harbor may be delimited by a number of fixed structures, for instance a wharf 2 and two piers 3, 4 which may be for instance substantially perpendicular to the wharf. Some of the fixed structures of the harbor might also be constituted by fixed floating docks or pontoon(s) or any form of pillars 36 like dolphins (not shown).

The floating moorage 1 may be composed of a set of n parallel floating booms 5, each extending longitudinally in a first horizontal direction X (i.e. substantially parallel to the pears 3, 4 and perpendicular to the wharf 2 in the example shown on FIG. 1), from a first end (which is close to the wharf 2 in the example shown on FIG. 1) to a second end (which is opposite to the wharf 2 in the example shown on FIG. 1).

The number n of parallel floating booms 5 is at least 2 and may be of 3 in the example shown on FIG. 1.

Each floating boom 5 includes:

a main floating pontoon 6 which extends along the first direction X;

and a number of secondary floating pontoons 7, 8 which extend on both sides of the main pontoon 6, substantially parallel to a second horizontal direction Y which is perpendicular to the first direction X.

These secondary pontoons 7, 8 delimit mooring places 9 in which ships 10 can be moored substantially perpendicularly to the main pontoon 6. In the simplified example shown on FIG. 1, only one ship 10 is moored in each mooring place 9, but the mooring places 9 can be designed to receive for instance two ships 10, disposed parallel to one another, each along one of the secondary pontoons 7, 8 which delimit the mooring place 9.

The secondary pontoons include spacing secondary pontoons 7 which may be of relatively large width in the first direction X and which may have a length L in the second direction Y (computed from the corresponding side of the main pontoon 6). This length L is longer than:

the ships 10 moored on the same side of the main pontoon 6, and the other secondary pontoons 8 (called finger pontoons) which are disposed on the same side of the corresponding main pontoon 6.

The finger pontoons 8 are relatively narrow in the first direction X, and are mainly used for attaching mooring lines connected to the ships 10, and for gaining access to the ships 10. The ships may be moored to the finger pontoons 8 only, or to the finger pontoons 8 and to the main pontoons 6, by classical mooring ropes and/or by mooring arms such as, for instance, those described in WO-A-2009/015403 or U.S. Pat. No. 4,206,717. The finger pontoons 8 may be omitted, for instance when the ships are moored by mooring arms such as those described in WO-A-2009/015403, connected by pairs to the corresponding main pontoon 6.

The number of spacing secondary pontoons 7 provided in each floating boom 5 is preferably at least 2 and these secondary pontoons 7 are preferably disposed in register from one floating boom 5 to the adjacent floating boom, so that the free ends of the spacing secondary pontoons 7 may come in abutment against one another when adjacent floating booms are brought together, so that the floating booms are thus stackable as will be explained hereafter in greater details.

Besides, the free ends of the spacing secondary pontoons 7 which are directly facing the piers 3, 4 may also come into abutment with said piers 3, 4 (or with a fixed floating dock—not shown—disposed along said piers 3, 4), when the corresponding floating booms 5 are pulled close to said piers 3, 4, as explained hereafter.

Due to the protruding length L of the spacing secondary pontoon 7 on both sides of the main pontoons 6, the ships 10 and finger pontoons 8 of each floating boom do not interfere with the ships 10 and finger pontoons 8 of the adjacent floating boom when said floating booms are brought together and said ships and finger pontoons do not interfere either with the piers 3, 4 when the floating boom 5 which is adjacent to one of said piers 3, 4 is pulled in contact to said pier.

In the example shown on FIG. 1, the spacing secondary pontoons 7 are disposed at each longitudinal end of a floating boom 5, but said spacing secondary pontoons 7 could be disposed otherwise provided the spacing secondary pontoons of each floating boom are disposed in register from one floating boom 5 to the other in order to ensure a stable abutment between adjacent booms 5 and between booms 5 and piers 3, 4. Further, the spacing secondary pontoons 7 are shown as being constituted, at each longitudinal end of the main pontoon 6, by a unique pontoon extending in the second direction Y which protrudes on both sides of this main pontoon, but the spacing secondary pontoons 7 could also extend each on one single side of the main pontoon 6, so that each boom would include at least 4 spacing secondary pontoon 7 (2 on each side, separated by the main pontoon 6).

The floating moorage 1 further includes an actuating system composed of winches 13 and of lines 14 such as chains, cables or ropes (more particularly ballasted ropes), which are wound on said winches.

The winches 13 may be in particular motorized winches, including an electric or hydraulic motor 13*a*, in all the embodiments of the invention. The axis of rotation of each winch 13 may be either horizontal as shown in the drawings, or vertical, in all the embodiments of the invention.

The winches 13 may for instance be driven by their respective motors 13*a* through torque limiters adapted to limit the torque which is applied by the motor 13*a* to the winch 13, so that the winch 13 pulls the corresponding line 14 with a controlled traction force which is limited to a certain maximum value.

The lines 14 of the actuating system are divided into:

a series of n+1 first lines (i.e. 4 first lines in the present case) extending substantially in the second direction Y and connecting the floating booms 5 together and to the piers 3 at the first end of said booms, i.e. opposite the wharf 2 in the example shown on the FIG. 1;

and a series of n+1 second lines extending in the second direction Y and connecting together the floating booms 5 and the piers 3, 4 at the second end of the floating booms.

Thus, for each floating boom 5, two lines of each series extend from said floating boom in two opposite ways in the second direction, either to an adjacent floating boom, or to a fixed anchorage (i.e. the piers 3, 4 in the example of FIG. 1).

Summarizing, each series of lines 14 include:

one line 14 connecting the pier 3 (or any other fixed structure) to the closer floating boom 5, n−1 lines 14 connecting together adjacent floating booms, and one line 14 connecting the pier 4 (or any other fixed structure) to the closer floating boom 5.

Further in the example of FIG. 1, the lines 14 of each series are separate and each line 14 is separately wound on one of the winches 13, so that the winches 13 also include two series of n+1 winches. These winches are fixed either to the floating booms 5, or to the piers 3, 4.

Figure 3:
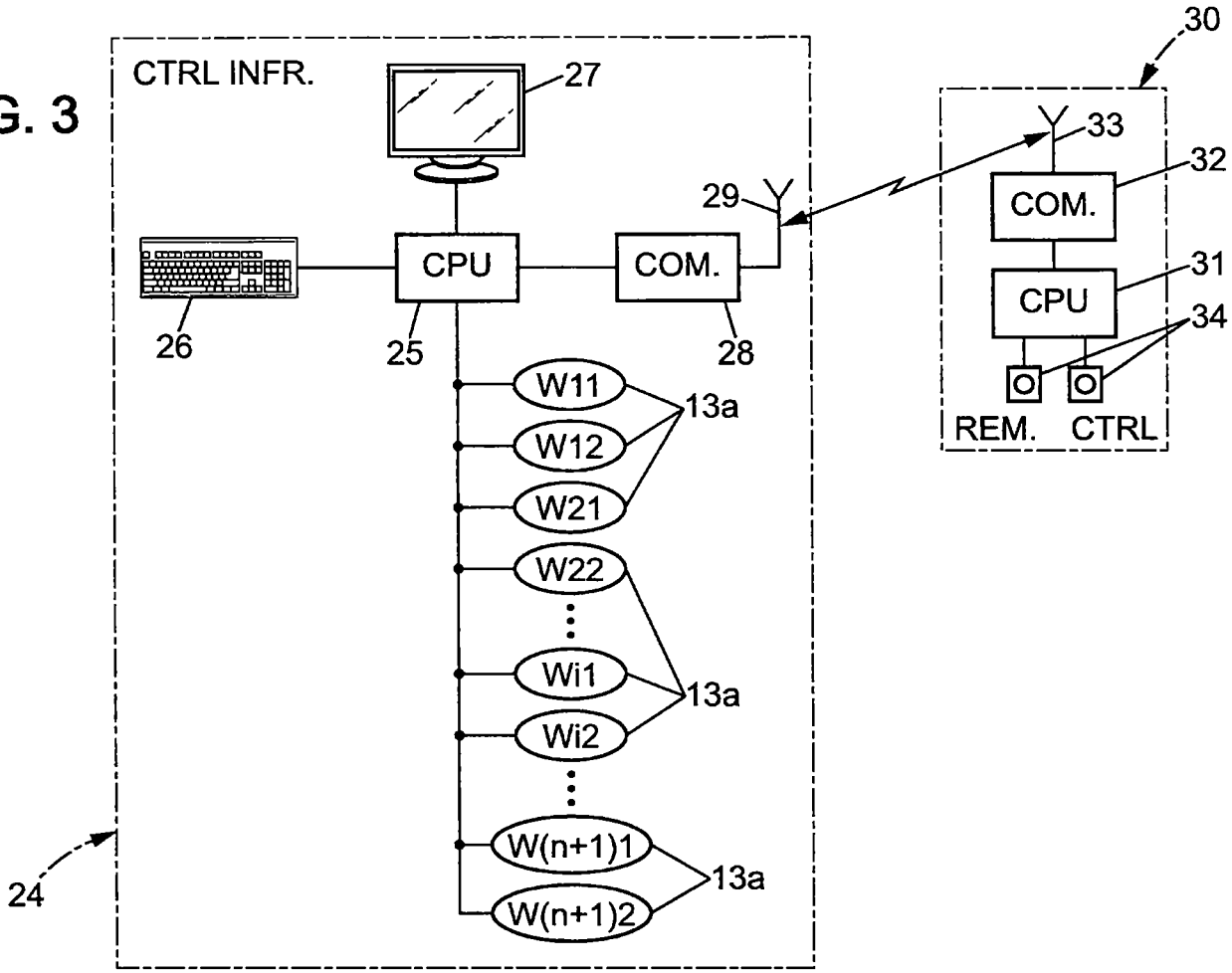
FIG. 3 is a block diagram illustrating the control system of the floating moorage of FIG. 1.

In the example shown on FIG. 3, two winches 13 of each series are fixed on the piers 3, 4, while n−1 winches (i.e. 2 winches in the example shown) are fixed on the floating booms, and more particularly on the spacing secondary pontoons 7 of these booms. The end of each line 14 which is not wound on a winch 13 is fixed to an anchorage 14*c* on one of the booms.

However, in all the embodiments of the invention, the disposition of the winches 13 might be different (all the winches 13 might for instance be installed on floating booms), and the two series of winches 13 and lines 14 might be installed at other positions on the floating booms 5 (e.g. on the spacing secondary pontoons 7, or on the main pontoons 6, or on specific intermediate pontoons (not shown) connecting together two aligned main pontoons, otherwise), provided the two series of winches 13 and lines 14 remain separated by a certain distance in the first direction X.

Figure 2:
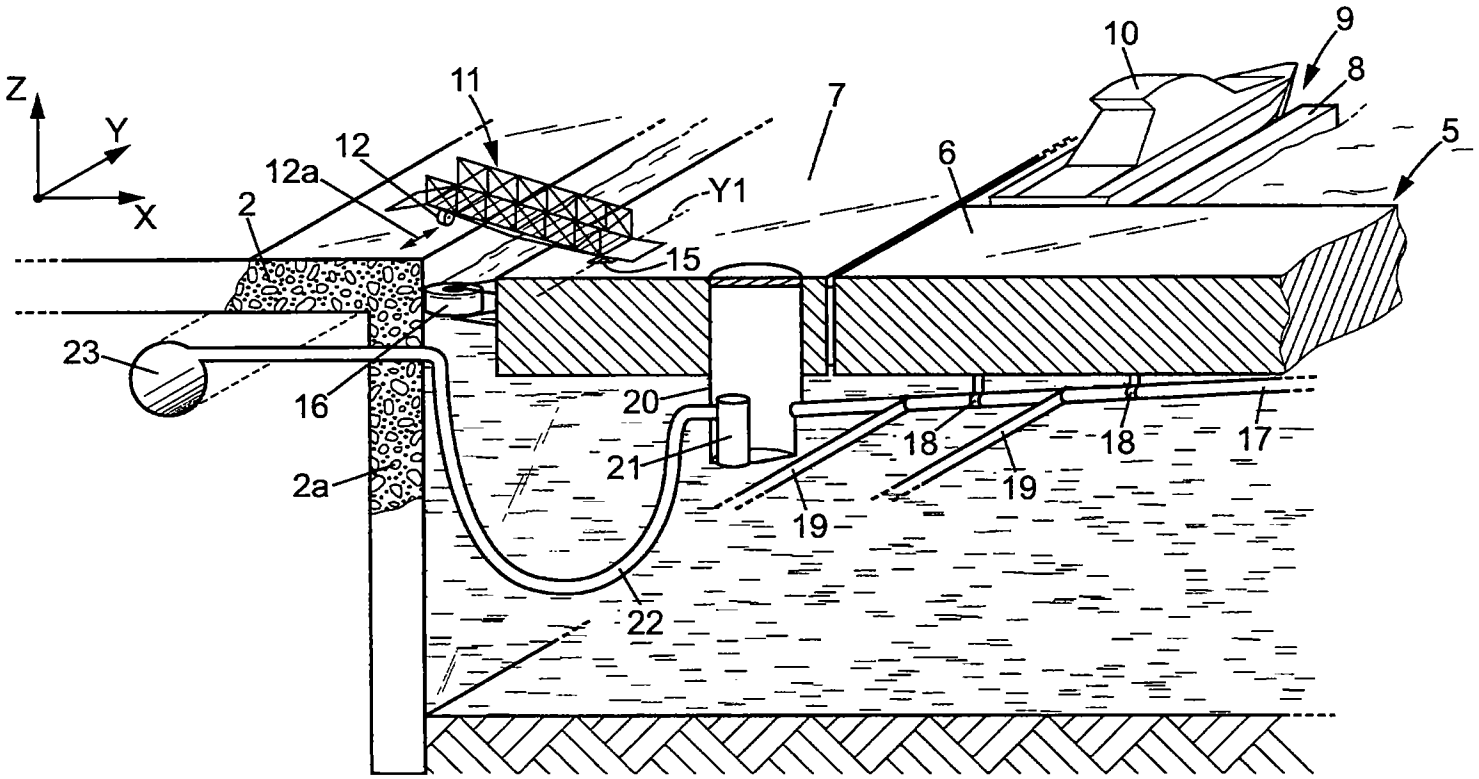
FIG. 2 is a more detailed section view of one of the floating booms of the moorage of FIG. 1.

As shown in more details on FIG. 2, the first end of at least one of the floating booms 5 may be fitted with a gangway 11 enabling to gain access to the floating boom 5. This gangway 11 may be fixed to the floating boom 5, for instance to the spacing secondary pontoon 7 at the first end of said floating boom 5, by an articulation 15 or similar at one end of said gangway 11. The other end of said gangway 11 bears on a fixed support surface, for instance on a horizontal surface of the wharf 2, through at least one roller 12 which is mounted at said end of the gangway 11 and which is adapted to roll on said support surface in the second direction Y, as represented by the double arrow 12*a* on FIG. 2, when the floating boom 5 is moved in the second direction Y by the actuating system.

Further, the floating booms 5 (or more generally at least one of the floating booms 5) may have its first longitudinal end (i.e. the spacing secondary pontoon 7, which is closer to the wharf 2 in the example shown on FIG. 2), specially adapted to bear against the wharf 2 in the first direction X, in one way only (i.e. toward the wharf 2).

In this purpose, the first end of the floating boom may be fitted with at least one roller 16 which is adapted to roll against the wharf 2 in order to guide the floating boom 5 in its movement parallel to the second direction Y, when said floating boom is actuated by the actuating system. More particularly, the roller 16 may roll on a vertical wall 2*a* of the wharf 2, or possibly on an inclined wall or on any other guiding surface which extends parallel to the second direction Y. It should be noted that, instead of bearing against the wharf 2 through the roller 16, the floating boom 5 might as well bear against a fixed floating dock (not shown), which would extend parallel to the second direction Y.

The roller 16 may for instance include a rubber rolling surface and include for instance an inflatable tire. The roller 16 may be connected to the floating booms 5 by any known means, for instance by a cantilever arm which may be fixed to the floating booms 5 by a damping rubber mount (not shown). This cantilever arm may for instance be articulated on the floating booms 5 in order to obtain a maximum damping effect.

Finally, as shown on FIG. 2, the floating booms 5 may be fitted with a sewage installation including for instance a main sewage conduit 17 which may run in the first direction X and which may be for instance fixed under the main pontoon 6 by mountings 18.

This main conduit 17 is connected to secondary sewage conduit 19 extending in the second direction Y and adapted to be connected to the water drain of ships 10 moored in the mooring places 9.

The main sewage conduit 17 may for instance be continuously inclined toward either directly to a sewer equipment ashore, or to a tank 20 (being either a containers made from, or enclosed in, or placed between the floatation elements of the pontoons) which is fixed to the floating boom 5 near the first longitudinal end thereof, for receiving waste water from the main sewage conduit 17. The tank 20 may include a lift pump 21, which is adapted to pump the waste water arriving in the tank 20, the outlet of said lift pump 21 being connected to a fixed sewer 23, located on or in the ground (for instance in the wharf 2) through at least one flexible conduit 22 which is adapted to deform when the floating boom 5 is moved in the second direction Y by the actuating system.

As shown on FIG. 3, the actuating system of the floating moorage 1 can be either manually operated, or remotely controlled by a control system including a control infrastructure 24 (CTRL INFR.) having a central processing unit 25 (CPU) such as a computer or similar, which may be connected to various user interfaces such as a keyboard 26, a screen 27, etc.

The central processing unit 25 controls all the motors 13*a* of the various winches 13 (reference W1.1, W1.2, W2.1, W2.2 . . . Wi.1, Wi.2 . . . W(n+1).1, W(n+1).2 on FIG. 3), so that said central processing unit 25 may control independently each of the first winches Wi.1 and each of the second winches Wi.2.

The central processing unit 25 may be programmed with a specific software which enables an operator (belonging for instance to the harbor authority) to indicate what mooring place 9 is to be accessed by a ship 10 of left by a ship 10, and then this software is adapted to determine automatically the movements of the floating booms to be effected in order to liberate an access channel 5*a* for this mooring place 9, and to actuate the corresponding winches 13.

Further, the control system may also include a number of portable remote control devices 30 (REM. CTRL) which are distributed to users of the floating moorage and which are adapted to communicate wirelessly, for instance by radio, with the control infrastructure 24.

More precisely, the control infrastructure may include a communication interface 28 (COM.), for instance a radio interface fitted with an antenna 29, which is adapted to communicate by any known communication protocol with a similar communication interface 32 (COM.) of each portable remote control device 30, which is also fitted with an antenna 33.

The communication interface 32 of the portable remote control device 30 may possibly be controlled by an electronic controller 31 (CPU) which may for instance be connected to two contacts 34 which the user may actuate through control buttons, for instance respectively:

- to open an access channel 5*a* in the floating moorage, communicating with the mooring place 9 of the user;
- to close such access channel 5*a;*
- and possibly to put any movement on hold More precisely, the controller 31 of each portable remote control device may include a unique user identification code, and the central processing unit 25 may include a data base of all the mooring places 9 of the floating moorage 1 and of the corresponding user identification codes.

Thus, when a user presses on one of the two buttons corresponding to the two contacts 34 of his/her portable remote control device 30, the corresponding user identification code is transmitted by the portable remote control device to the control infrastructure 24 and the central processing unit 25 can then determine the mooring place 9 corresponding to the portable remote control device 30, which has been actuated. Then the central processing unit determines which winches are to be actuated to open or close a corresponding access channel, according to the button pressed by the user, and actuates said winches. In this embodiment, the corresponding access channel may be left open by the control system for a predetermined time after the "open" button has been pressed, unless the "close" button is actuated.

In a variant, the remote control device 30 might include one single button corresponding to one single contact 34, controlling only the opening of the access channel 5*a* communicating with the corresponding mooring place 9.

In such a case, the access channel 5*a* which has thus be opened can be automatically closed by the control system after a predetermined time, or simply left open, or controlled by any other appropriate means (besides eventual override by harbour authorities) like video recognition or monitoring system(s). In a variant, the control device may include two contacts 34 actuated through two control buttons, one for opening an access channel 5*a* corresponding to the control device 30, and the other for holding said access channel 5*a* open during the maneuver of the ship in said access channel 5*a*, in case the maneuver is longer than usual, to avoid the access channel 5*a* be closed during the maneuver of the ship.

In other variants, the control devices 30 could be constituted by cell phones or other radio devices (such as the vhf radios of the ships). Further, the actuating system could also be actuated from the pontoons or from the ground, by control boxes fitted with a keyboard enabling a user to enter a user identification code, or fitted with an electronic card reader or else.

The above control system and its variants may be used in all the embodiments of the invention.

Thanks to the actuating system, the movable floating moorage 1 can be placed in several configurations, each enabling to open or close an access channel 5*a:*

Figure 4:
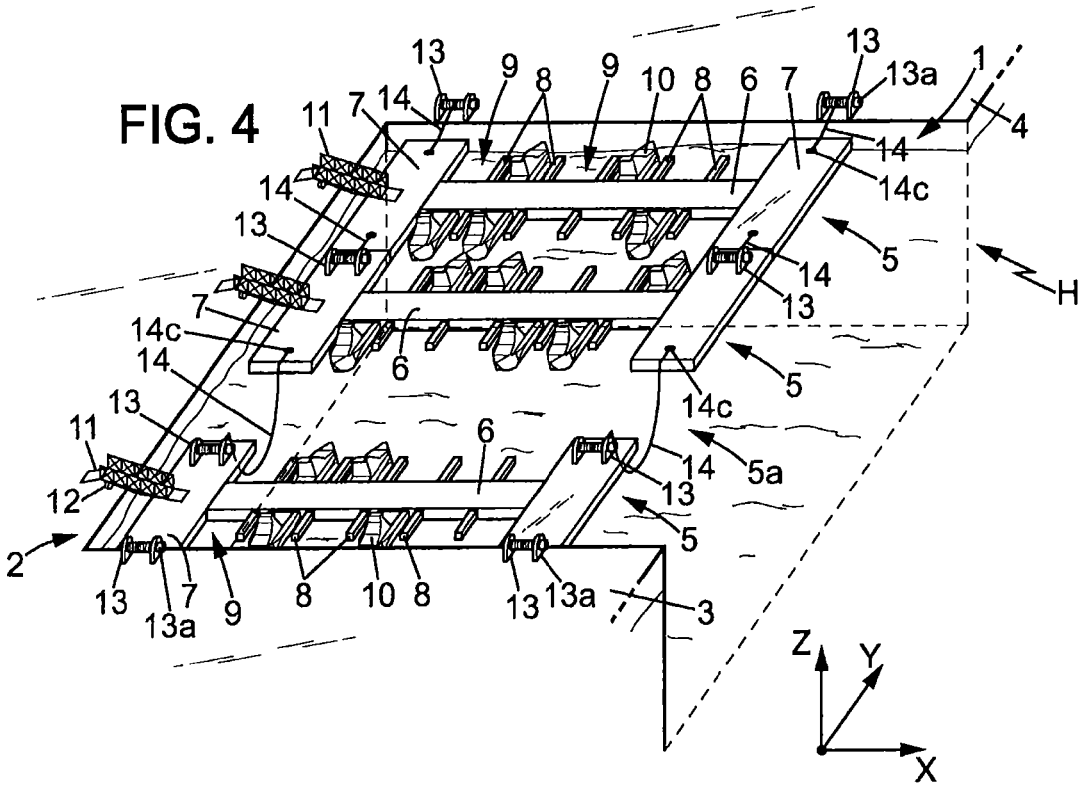
FIGS. 4-6 are views similar to FIG. 1, illustrating three other positions of the floating moorage of FIG. 1, enabling to gain access to the various mooring places of the floating moorage.
Figure 5:
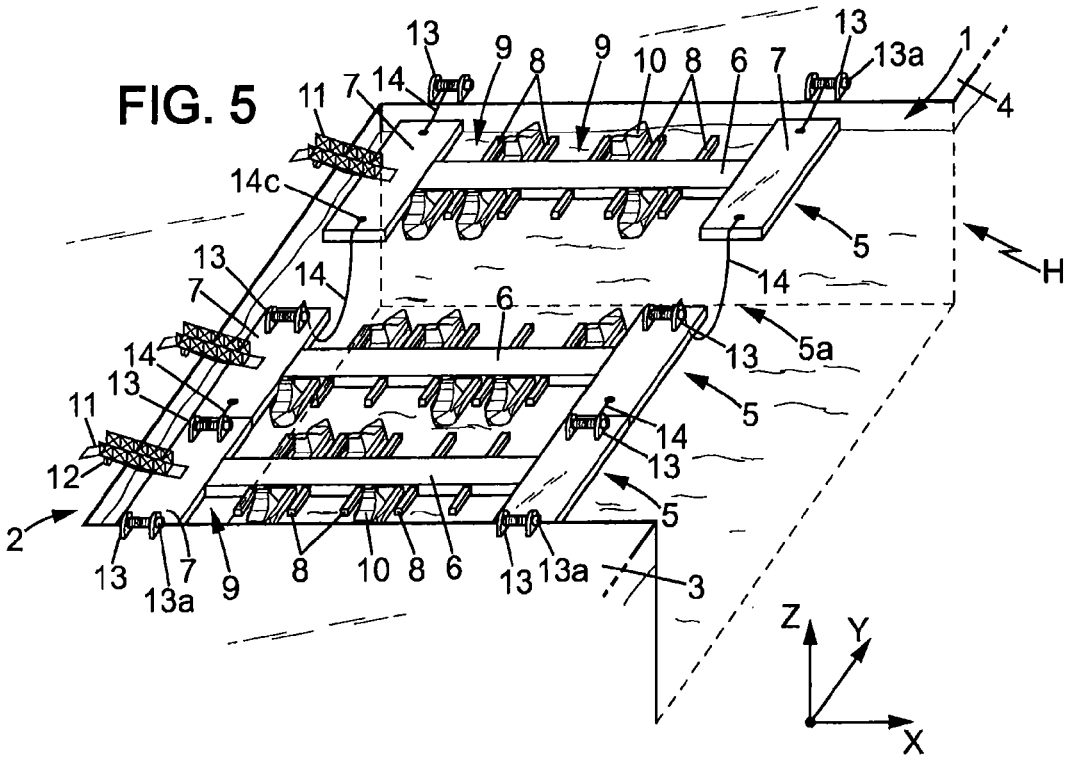
Figure 6:
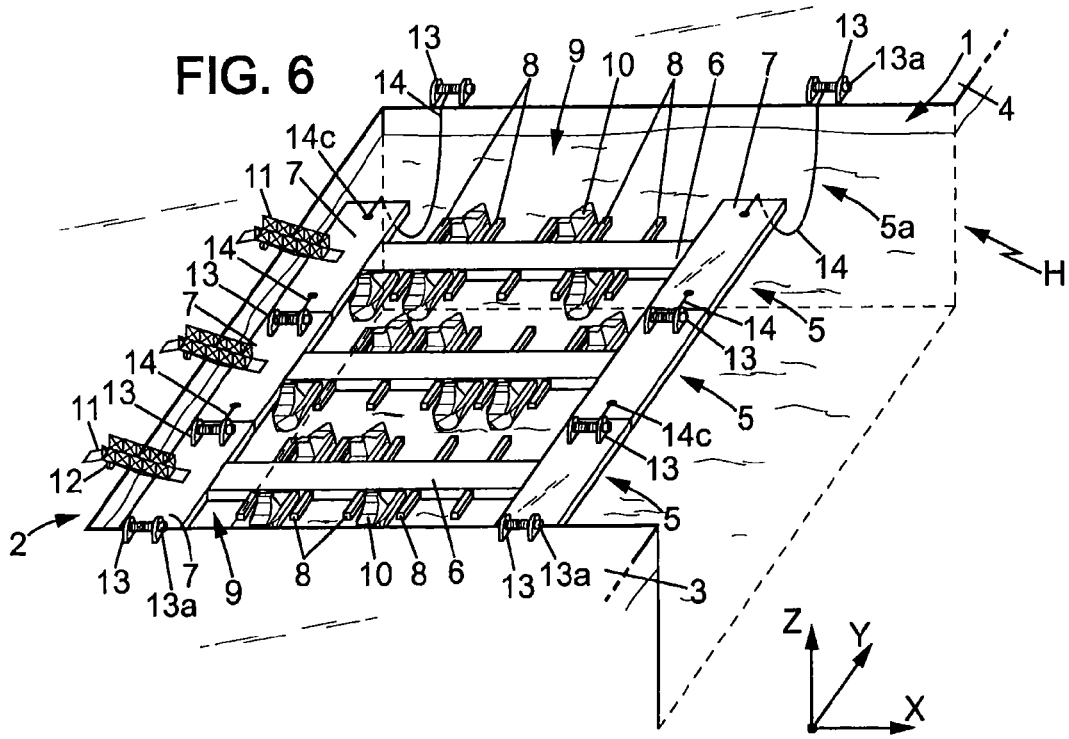

- either between the pier 3 and the floating boom 5 which is closer to said pier (see FIG. 1);
- or between the floating boom 5 which is closer to the pier 3 and the next floating boom 5 (see FIG. 4);
- or between the middle floating boom 5 and the floating boom 5 which is closer to the pier 4 (see FIG. 5);
- or between the pier 4 and the floating boom 5 which is closer to said pier 4 (see FIG. 6).

The movements of the floating booms 5 in the second direction Y are obtained by winding and unwinding the lines 14 on their respective winches 13. In each case, all the lines 14 are wound on their respective winches 13 and maintained under tension, except the first and second lines 14 which correspond to the access channel 5*a*, which remain loose and which sink under their own weight (or additional ballast), sufficiently deeply not to interfere with the ships 10 passing in said access channel 5*a*.

Besides, since the floating booms 5 are connected to the ground solely by the lines 14, there is no risk of jamming during movements of said booms, thanks to the suppleness of the lines 14.

It should be noted that, instead of being totally wound on the winches 13, the length of the lines 14 which is in excess could be "stored" under water, such length in excess sinking under its own weight or under the weight of additional ballast attached to one free end of the line 14.

Due to the fact that all the lines 14 but those corresponding to the access channel 5*a* are maintained under tension with a predetermined and limited traction force (and/or end of travel contacts) by the winches 13, the floating booms 13 are stably maintained in abutment on each other and on the piers 3, 4, through their spacing secondary pontoons 7. Further, since the traction force exerted by the winches 13 is maintained permanently and limited to a maximum value, the floating moorage 1 is compatible with tidal movements of the water in the harbor H.

In a variant, the winches 13 might not include torque limiters but could simply be locked in position when not actuated by their motors 13*a*, in which case it might be necessary for the control unit 25 to permanently control winding and unwinding of the winches 13 corresponding to the lines 14 which connect the piers 3, 4 to the closer booms 5, as a function of an automatic measurement of the water depth in the harbor H. In another variant, the moving booms 5 might not be connected to the piers 3,4, but to fixed floating docks, in which case it might not be necessary to provide the winches 13 with torque limiters in order to adapt to tidal movements.

FIGS. 7-11 show several other embodiments of the invention which are similar to the first embodiment already described with reference to FIGS. 1-6 and which will therefore not be described again in details. In the following, we will mainly discuss the differences between the first embodiment and these further embodiments.

Figure 7:
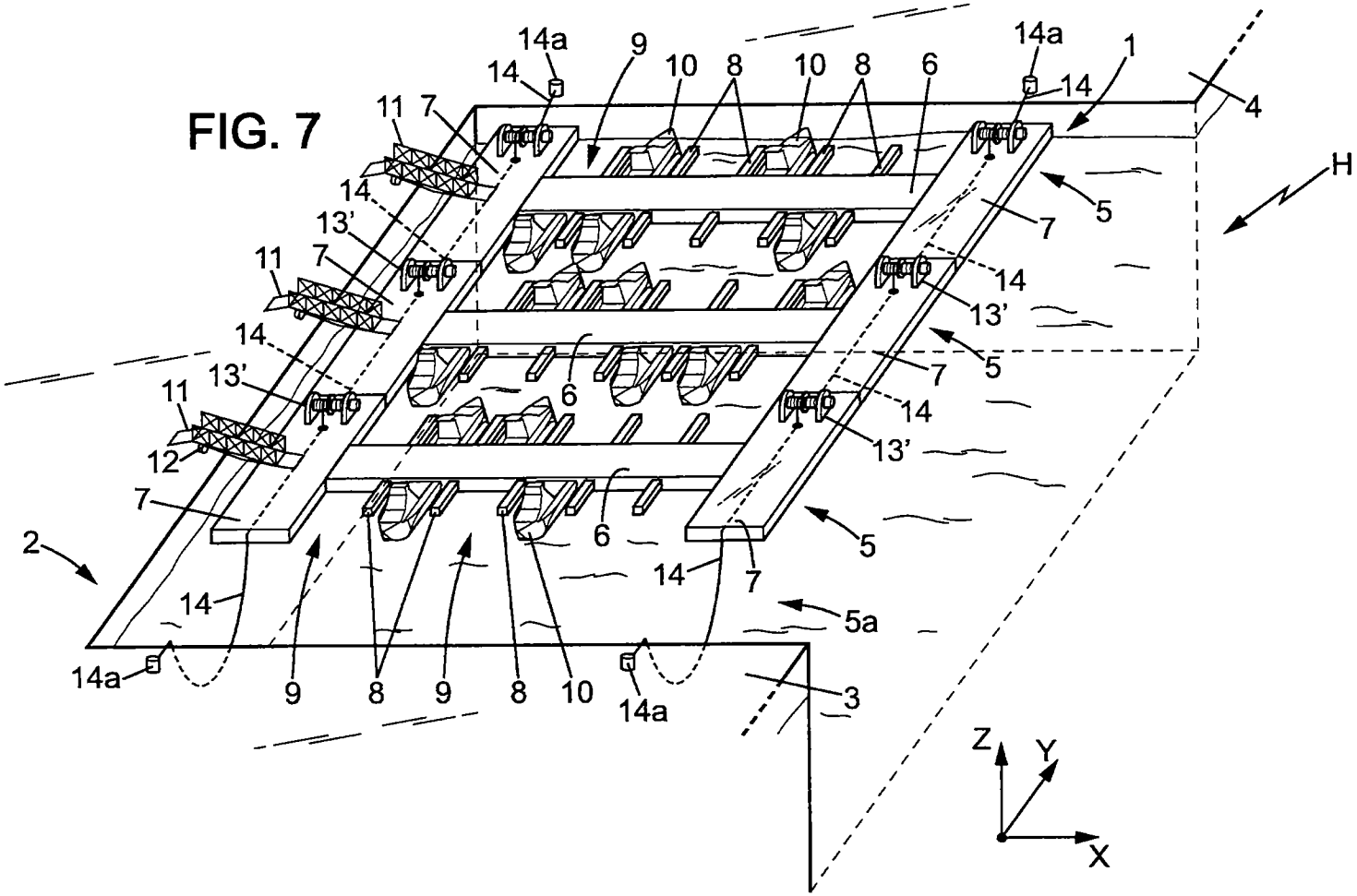
FIG. 7 is a view similar to FIG. 1, illustrating a floating moorage according to a second embodiment of the invention.
Figure 7A:
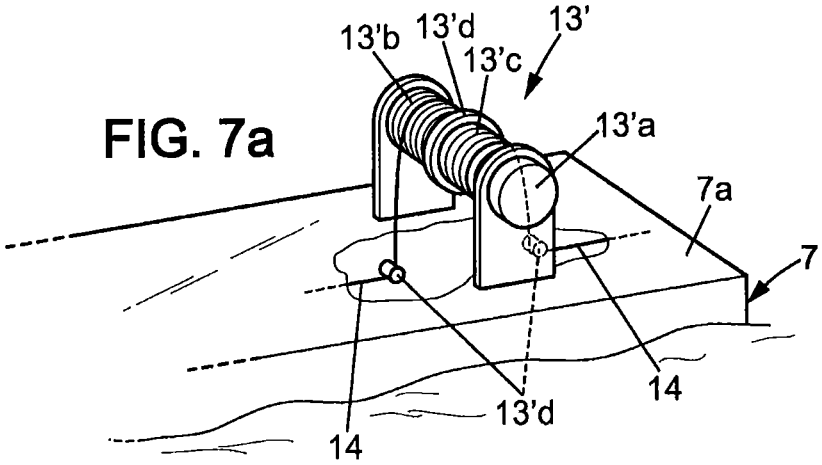
FIG. 7*a* is a detailed view of one of the winches of the floating moorage of FIG. 7.

In the second embodiment of the invention, shown on FIGS. 7 and 7*a*, the n+1 lines of each series are controlled by only n winches 13' which are mounted respectively on the n floating booms 5.

In this case, no winch is mounted on the piers 3, 4, and the first and second lines 14 which are connected to the piers 3, 4 are attached to fixed anchorages 14*a* on said piers 3, 4 (or on any other fixed support structure, which may be floatable or not). In the example shown on FIG. 7, the winches 13' are mounted on the decks of the spacing secondary pontoons 7 whereas the lines 14 are passing underneath said decks, but of course, the winches 13' and lines 14 might be disposed differently on the floating booms 5. In particular, the winches 13' might be disposed underneath the decks 7*a* of the spacing secondary pontoon 7 as well.

As shown on FIG. 7*a*, the two lines 14 of each series, which are connected to the same floating boom 5, are wound in the same angular direction on the winch 13, so that winding of one of the lines 14 implies unwinding of the other line 14 connected to the same winch 13'.

The winches 13' may be a motorized winches as previously discussed, actuated by a motor 13'*a* which may be coupled to the winch 13' by a torque limiter as in the first embodiment of the invention.

The winch 13' may include two juxtaposed drums 13'*b*, 13'*c* which may be separated for instance by a separating flange 13'*d*, for winding separately the two lines 14 which are connected to the same winch 13'. Further, each line 14 may pass on a deflecting pulley 13'*d* or similar underneath the deck of the corresponding spacing secondary floating pontoon 7.

The other elements of the floating moorage 1 and of its control system are identical or similar to those previously described.

It should be noted that, in this embodiment of the invention, each series of lines 14 can be constituted by n+1 separate lines as in the example of FIG. 7, or could be constituted by a single continuous cable, rope or chain which would be wound on each of the winches 13' and would continuously extend between the two fixed anchorages 14*a* corresponding to said series of lines 14. In this case, each floating boom could possibly include two winches on each series of lines 14, for instance one winch at each end of the corresponding spacing secondary pontoon 7. As in all other embodiments of the invention, the axes of rotation of the winches 13' can be either horizontal as shown in the drawings, or vertical, or else.

Figure 8A:
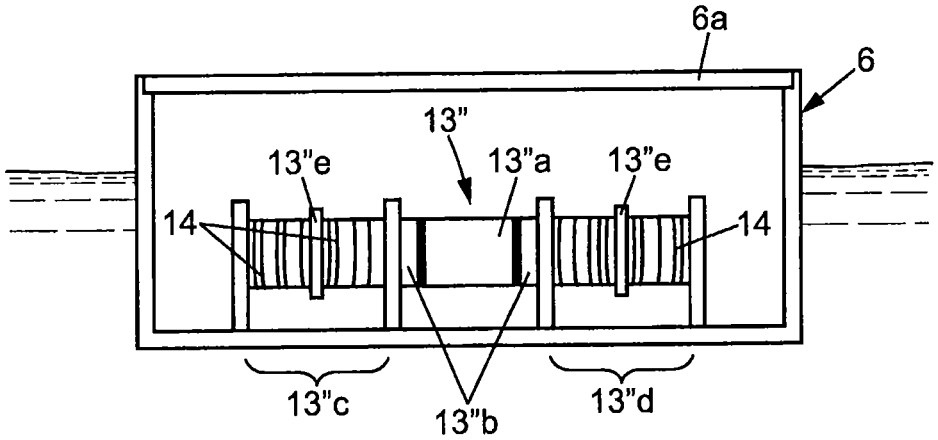
FIG. 8*a* is a cross-section view of the main pontoon of one of the floating booms of the floating moorage, showing two coupled winches mounted inside this main pontoon.
Figure 8:
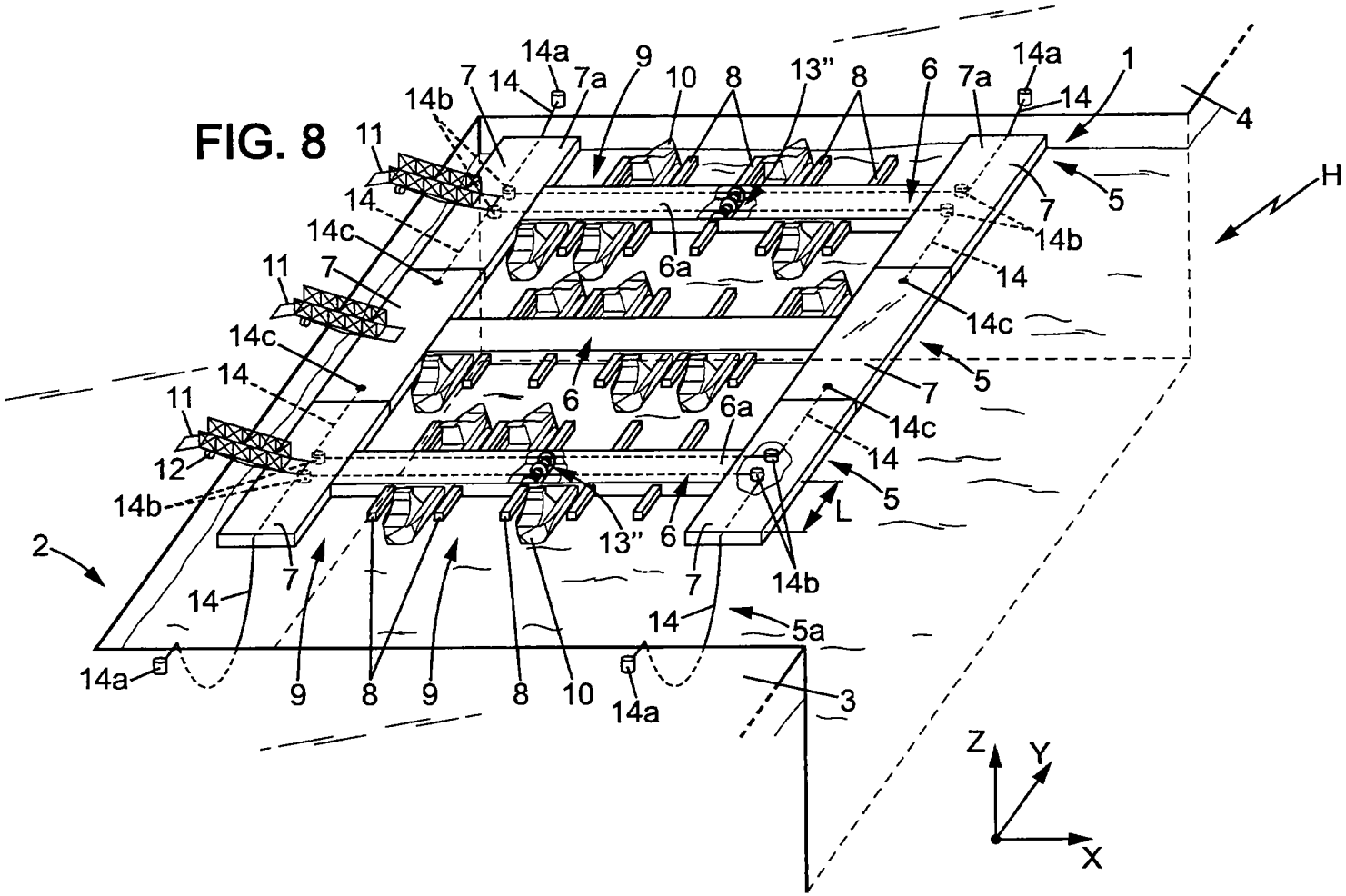
FIG. 8 is a view similar to FIG. 1, illustrating a floating moorage according to a third embodiment of the invention.

In the third embodiment of the invention, shown on FIGS. 8 and 8*a*, each series of first and second lines 14 include n+1 separate lines 14 (i.e. 4 lines 14) in the example of FIG. 8. The 2n+2 first and second lines 14 are driven by n+1 winches (13"*c*, 13"*d* (i.e. four winches 13"*c*, 13"*d*) which are distributed in two sets of winches 13". In this example, the sets of winches 13" are disposed underneath the decks 6*a* of the main pontoon 6 to floating booms 5 namely the two floating booms which are closer to the piers 3, 4 in the example shown on FIG. 8.

In this example, all the lines 14 are also passing underneath the decks 6*a*, 7*a* of the pontoons 6, 7. Each winch 13"*c*, 13"*d* is connected to two symmetric first and second lines 14 which are connected to either a fixed anchorage 14*a* of the same fixed structure (i.e. of one of the piers 3, 4 in the example of FIG. 8), or to two anchorages 14*c* of the same adjacent floating boom 5 (i.e. the middle floating boom in the example of FIG. 8).

The first and second lines 14 which are connected to the same winch 13"*c*, 13"*d* are disposed to be simultaneously wound on said winch 13"*c*, 13"*d* or unwound from said winch 13"*c*, 13"*d*.

Further, in the example of FIG. 8, the first and second lines 14 which are connected to the same winch 13"*c*, 13"*d* run in opposite ways in the first direction from the corresponding set of winches 13" along the main pontoon 6 and then penetrate respectively in the two spacing secondary pontoons 7 of the same floating boom, where they pass respectively on two deflecting pulleys 14*b* before running in the second direction Y toward the corresponding anchorage 14*a*, 14*c*.

As shown on FIG. 8*a*, each winch 13"*c*, 13"*d* may form two juxtaposed drums separated by a flange 13"*e*, on which the two corresponding first and second lines 14 are wound. Further, the two winches 13"*c*, 13"*d* of each set of winches 13" may be actuated by a single motor 13"*a* which is selectively coupled to one of the two winches 13"*c*, 13"*d* by a respective clutch 13"*b*, preferably including or forming a torque limiter.

The control and operation of the floating moorage of the third embodiment are similar to that of the first embodiment, except that the two winches 13"*c*, 13"*d* of each set of winches 13" are preferably actuated in turn and not simultaneously. Further, in this third embodiment, the winches 13"*c*, 13"*d* are preferably locked in position rather than continuously actuated with a constant torque by their corresponding motor 13"*a*, except for the winches corresponding to lines 14 which are connected to the fixed anchorages 14*a*, which are preferably maintained under constant traction force, when the floating booms 5 are not moved, in order to adapt to the tidal movements of water in the harbor H.

Of course, in this third embodiment, it would be possible to provide each winch 13"*c*, 13"*d* with a separate motor coupled to this winch by a torque limiter, rather than having a common motor 13"*a*. Further, the winches 13"*c*, 13"*d* could be disposed in a different way on or in the pontoons 6, 7 of each floating booms 5.

Figure 9:
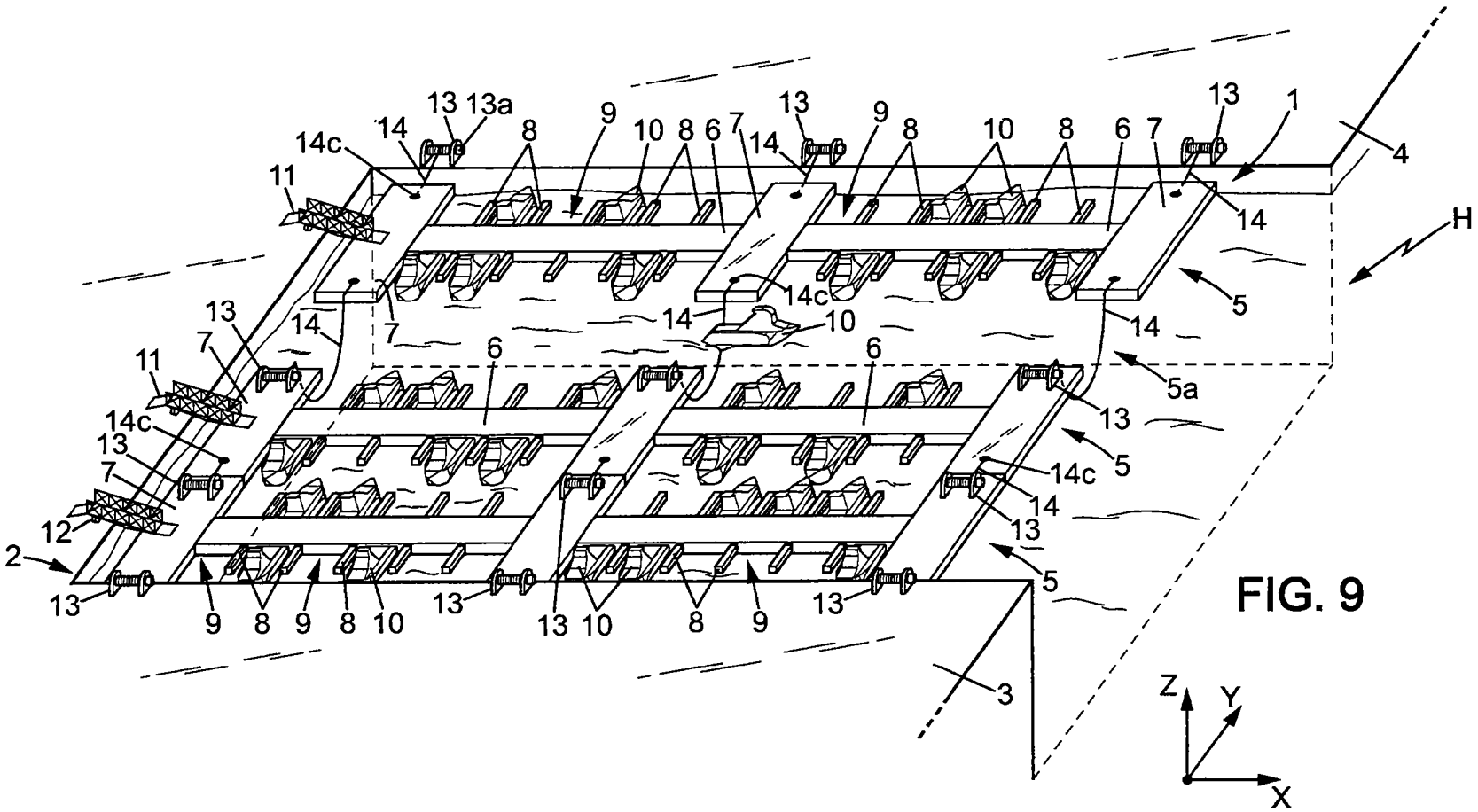
FIGS. 9-12 are views similar to FIG. 1, showing respectively floating moorages according to $4^{th}$, $5^{th}$, $6^{th}$ and 7th embodiments of the invention.

In the fourth embodiment of the invention, shown on FIG. 9, each floating boom 5 is longer than in the previous embodiments and may include for instance additional spacing secondary pontoon 7, so that each floating boom includes three spacing secondary pontoon 7 protruding on both sides of said floating boom in the second direction Y.

Further, in this fourth embodiment, the actuating system of the floating moorage 1 includes a series of n+1 third lines 14 and third winches 13 which are disposed and controlled as in the first embodiment of the invention. Of course, the actuating system in this fourth embodiment of the invention could be similar to the actuating system of other embodiments.

Figure 10:
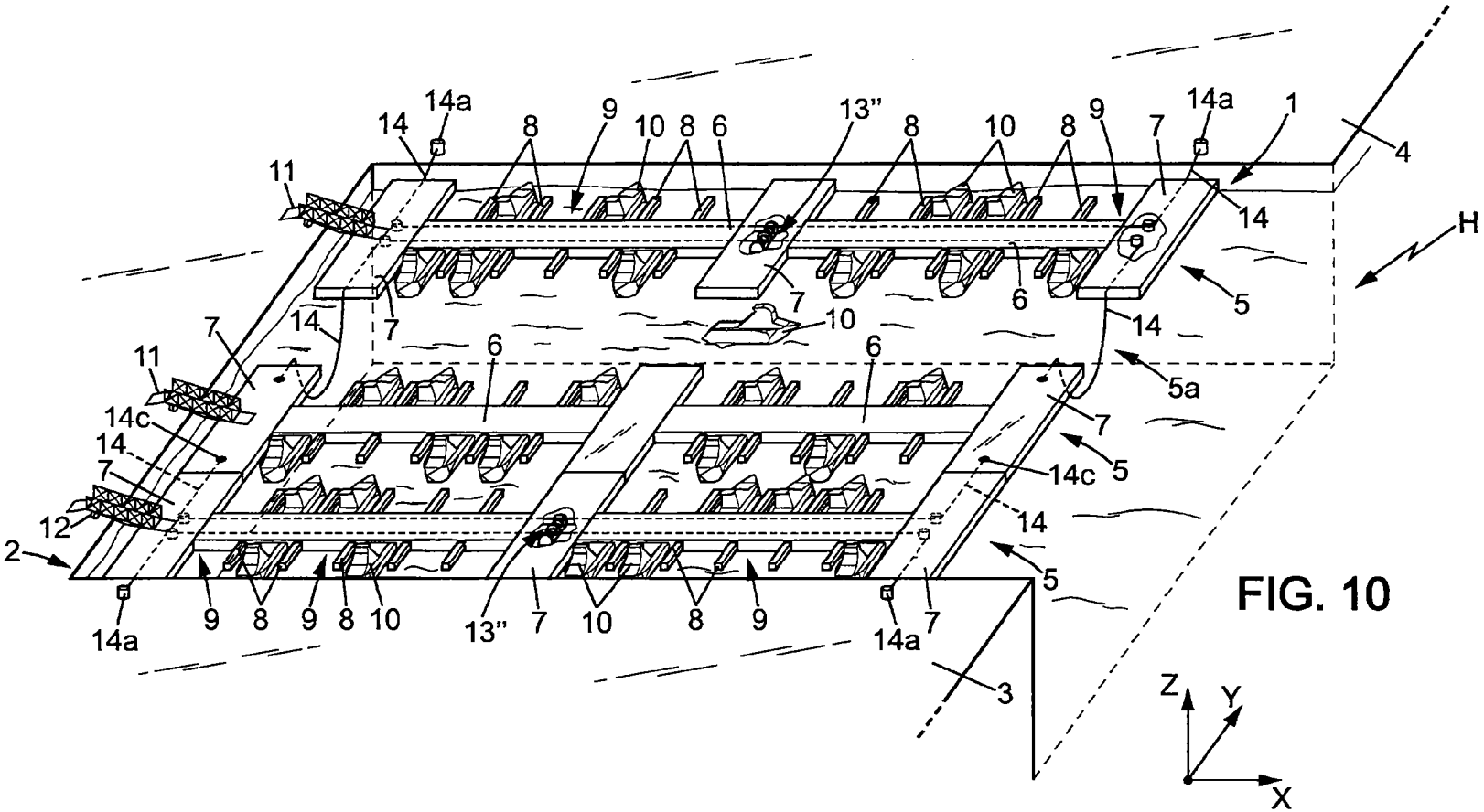

For instance, in the fifth embodiment of the invention, shown on FIG. 10, the floating boom 5 are similar to those of the fourth embodiment, while the actuating system is similar to that of the third embodiment (FIGS. 8-8*a*) with the sets of winches 13, disposed for instance in the intermediate spacing secondary pontoons 7 which are disposed substantially in the middle of the length of each floating boom 5.

Figure 11:
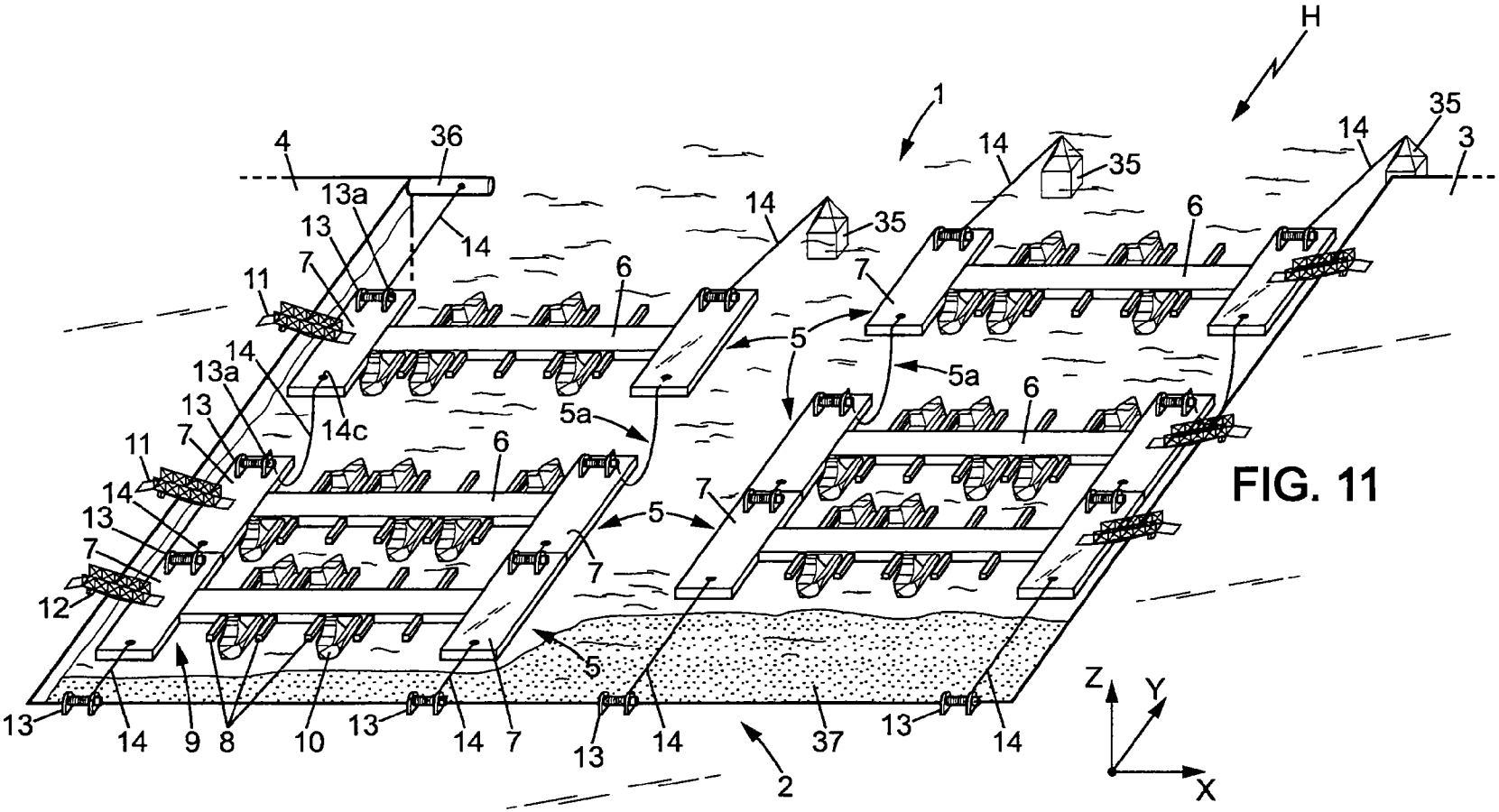
Figure 12:
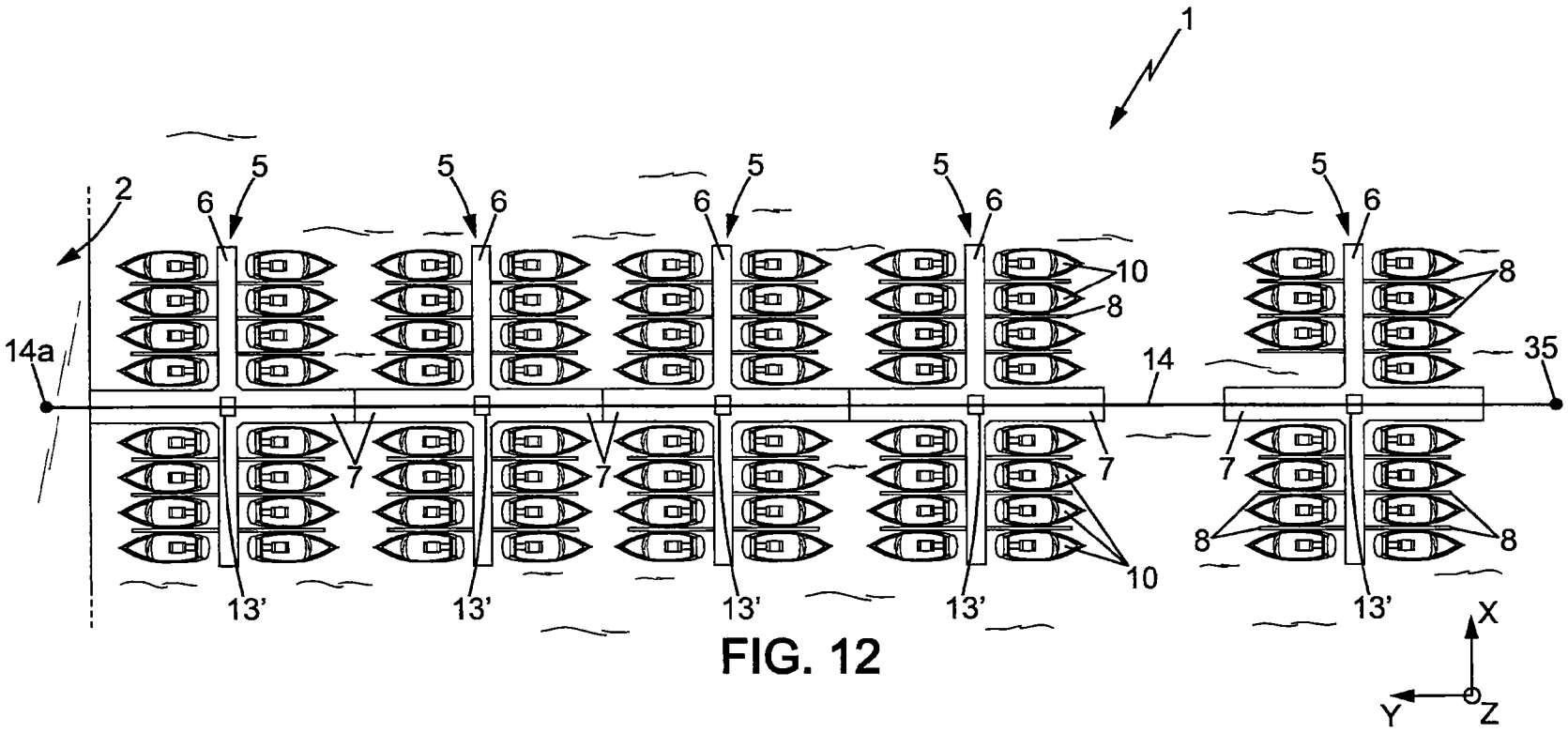

Finally, in the sixth embodiment of the invention, shown on FIG. 11, the floating moorage 1 includes two sets of floating booms 5 which are separated by a permanently open access channel, each of these sets of floating booms being similar to that of FIG. 1, except that:

the longitudinal direction X of the floating booms is now parallel to the wharf 2, the floating booms 5 being movable along the piers 3, 4 and the gangways 11 of said floating booms rolling on said piers 3, 4, with their rollers 12;

the floating booms 5 which are closer to the wharf 2 are connected to said wharf by at least first and second lines 14, which are wound on corresponding first and second winches 13, which may be installed either on said floating boom, or on the wharf 2 as shown;

the floating boom 5 of each set of floating booms which is opposite the wharf 2 is connected by first and second lines 14 either to a fixed anchorage 36 which is fixed to the corresponding pier 3, 4, for instance a cantilever beam 36 (or vertically a dolphin), or to an underwater mooring or buoys (any fixed point; eventually with ballast) 35 which is placed/located on the see bottom, the corresponding winches 13 being mounted preferably on said floating boom 5.

The control and operation of the floating moorage 1 according to the sixth embodiment of the invention is similar to that of FIG. 1, except that the floating booms which are closer to the wharf 2 may not be pulled in abutment with said wharf 2, for instance if an inclined bank is interposed between the water and said wharf 2, and similarly, the floating booms which are opposite the wharf 2 may not be pulled in abutment with a fixed structure. In this embodiment, the stability of the sets of floating booms is therefore ensured mostly by the mutual abutment between the spacing secondary pontoon 7 of the adjacent floating booms, and by a reasonable tension on the lines 14 which connect the floating booms to the wharf 2 and to the fixed anchorages 35, 36.

In the 7th embodiment of the invention, the line 14 may be continuous (or not, according to the various embodiments already disclosed), extending between a first fixed point 14*a* fixed for instance to a wharf 2, and a second fixed point which can be for instance a buoy 35 or similar, or a dolphin or similar, as described above.

In this 7th embodiment, each floating boom 5 has a main pontoon 6 extending in the first direction X, and a single secondary pontoon 7 extending both was from the main pontoon 5 in the second direction Y, so that each boom 5 is substantially in the shape of a crux. The secondary pontoons 7 are all aligned and serve both as abutment members when the booms are brought together, and optionally as gangway for the users. The line 14 (or optionally the lines 14 if several lines are provided) go along the secondary pontoons 7, and is controlled by individual winches provided on each of the booms 5, as already explained before in the various other embodiments of the invention.

It should be noted that in all embodiments of the invention, the floating booms 5 could be equipped with only clutches adapted to selectively couple/uncouple the boom 5 to at least a corresponding continuous line 14 running between two fixed points, while said line 14 would be actuated by e.g. a single winch (if the line 14 is shape like a loop, in which case the two fixed points are similar to pulleys) or two winches (e.g. one at each fixed point).

It should be noted that, in the present patent application, the wording "winch" includes all winches or actuating elements adapted to move and/or transfer movement, like for instance capstans, windlasses or parts of, like gipsy and blocks, sheaves, and/or clamps or stopper, clutches or any form of adapted lock.

The invention claimed is:

1. A movable floating moorage including at least a set of n parallel floating booms, n being an integer larger than 1 and each floating boom comprising a main floating pontoon extending along a first horizontal direction which is common to all main pontoons of the set of floating booms;

said movable floating moorage further including an actuating system including at least one flexible line which extends in a second direction substantially perpendicular to said first direction and adapted to selectively move each floating boom in both ways in said second direction;

wherein the floating booms are connected together and to any fixed support by lines in a way enabling free movements in all directions perpendicular to the second direction, and wherein said floating booms comprise spacing members which are adapted to form an abutment in the second direction for said floating booms, for maintaining the respective main pontoons of said floating booms at a predetermined minimum distance from one another and from adjacent fixed structures.

2. The movable floating moorage according to claim 1, wherein said actuating system includes:

a series of n+1 first lines extending between two first fixed anchorages, substantially in a second horizontal direction which is substantially perpendicular to said first direction, said series of first lines including, for each floating boom, two first lines extending from said floating boom in two opposite ways in the second direction and connected respectively, either to an adjacent floating boom, or to one of said first fixed anchorages;

winches which are respectively adapted to wind and unwind each of the n+1 first lines to move independently the n parallel floating booms relative to one another in the second direction.

3. The movable floating moorage according to claim 2, wherein said actuating system further includes a series of n+1 second lines extending substantially in the second direction between two second fixed anchorages and including, for each floating boom, two second lines extending from said floating boom in two opposite ways in the second direction and connected respectively, either to an adjacent floating boom, or to one of said two a second fixed anchorages, said second lines being respectively spaced apart from the corresponding first lines, and wherein said winches are also respectively adapted to wind and unwind each of the n+1 second lines to move independently the n parallel floating booms relative to one another in the second direction.

4. The movable floating moorage according to claim 3, wherein the series of first lines forms a continuous cable, chain or rope which extends continuously between the two first fixed anchorages and which is wound on each of the n first winches, and the series of second lines forms a second continuous cable, chain or rope which extends continuously between the two second fixed anchorages and which is wound on each of the n second winches.

5. The movable floating moorage according to claim 3, wherein said winches comprise:

n+1 first winches which are respectively connected to the n+1 first lines and adapted to wind and unwind independently each of the n+1 first lines;

and n+1 second winches which are respectively connected to the n+1 second lines and adapted to wind and unwind independently each of the n+1 second lines.

6. The movable floating moorage according to claim 3, wherein said winches comprise:

n first winches which are respectively mounted on the n floating booms, the first winch of each floating boom being connected to the two first lines extending from said floating boom and said two first lines being wound on said first winch in the same angular direction, so that winding one of said first lines on said first winch involves simultaneous unwinding of the other of said two first lines;

and n second winches which are respectively mounted on the n floating booms, the second winch of each floating boom being connected to the two second lines extending from said floating boom and said two second lines being wound on said second winch in the same angular direction, so that winding one of said second lines on said second winch involves simultaneous unwinding of the other of said two second lines.

7. The movable floating moorage according to claim 3, wherein said winches comprise n+1 winches which are respectively connected to both the n+1 first lines and the n+1 second lines, each winch being connected to corresponding first and second lines which extend from the same side of one of the floating booms, so as to wind and unwind independently both of said corresponding first and second lines.

8. The movable floating moorage according to claim 2, wherein said winches are motorized.

9. The movable floating moorage according to claim 8, wherein at least some of said winches are driven by pair by a common motor which is independently coupled by clutches to each winch of said pair.

10. The movable floating moorage according to claim 2, wherein each winch is adapted to exert a controlled traction force on a corresponding line which is wound on said winch.

11. The movable floating moorage according to claim 1, wherein each floating boom comprises at least two spacing members extending on both sides of the main pontoon thereof.

12. The movable floating moorage according to claim 11, wherein each floating boom comprises secondary floating pontoons extending from the main pontoon substantially in the second direction, said secondary pontoons including spacing secondary pontoons which constitute at least some of said spacing members.

13. The movable floating moorage according to claim 12, wherein said spacing secondary pontoons are disposed in mutual correspondence in each pair of adjacent floating booms of the set of parallel floating booms, and the spacing secondary pontoons which are disposed in mutual correspondence between the main pontoons of said pair of adjacent floating booms, are adapted to bear on one another in the second direction for maintaining the respective main pontoons of said adjacent floating booms at said predetermined minimum distance from one another when the actuating system brings together said adjacent floating booms.

14. The movable floating moorage according to claim 1, wherein the actuating system includes a control system which automatically controls said at least one line and which includes:

remote control devices which are distributed to users of the floating moorage and which include a user identification code identifying said users;

a communication interface adapted to communicate remotely with said control devices;

and at least a processing unit which is adapted to:

upon reception of a user identification code from a remote control device, determining a mooring place in one of the floating booms, corresponding to the user identification code, determining movements of floating booms necessary to open an access channel enabling a ship to access said mooring place or leave said mooring place, control said at least one line to perform said movements.

15. The movable floating moorage according to claim 1, wherein at least one of the floating booms is fitted with a sewage installation which is connected to a fixed sewer by a flexible conduit which is adapted to deform when the floating boom is moved by the actuating system.

* * * * *